US005390617A

United States Patent [19]

Van Breems

[11] Patent Number: 5,390,617

[45] Date of Patent: Feb. 21, 1995

[54] BOOM BRAKE

[76] Inventor: Martinus Van Breems, 571 Riverside Ave., Westport, Conn. 06880

[21] Appl. No.: 83,909

[22] Filed: Jun. 25, 1993

[51] Int. Cl.[6] ..... B63H 9/04

[52] U.S. Cl. ..... 114/98; 114/102

[58] Field of Search ..... 114/39.1, 39.2, 101, 114/102, 103, 98, 97, 99, 108, 112; 24/115 H, 115 L, 136 K, 127

[56] References Cited

U.S. PATENT DOCUMENTS

| | | | |
|---|---|---|---|
| 2,223,389 | 12/1940 | Schaedler | 24/127 |
| 3,391,907 | 7/1968 | Vogelsang | 114/102 |
| 4,138,962 | 2/1979 | Waelder . | |
| 4,630,564 | 12/1986 | Duckman et al. . | |
| 4,762,318 | 8/1988 | Phillips et al. | 24/136 K |
| 4,830,340 | 5/1989 | Knitig | 24/115 L |
| 4,912,814 | 4/1990 | McKenzie | 24/115 H |
| 4,941,420 | 7/1990 | Heintz . | |
| 5,070,802 | 12/1991 | Corlett | 114/98 |

*Primary Examiner*—Stephen P. Avila

[57] ABSTRACT

A boom brake for controlling the swinging motion of the boom of a sailboat includes a housing attached to the boom having two plates between which three bearing surfaces are mounted to engage a line attached to the sides of the sailboat in a serpentine path such that the line makes less than a full turn around each bearing surface to preclude overwrapping of the line. At least one of the bearing surfaces can be adjustably rotatable such that the force required to cause rotation can be selectively controlled. Braking of the boom motion is provided by sliding friction between the line and the bearing surfaces.

11 Claims, 5 Drawing Sheets

BOOM BRAKE

BACKGROUND OF THE INVENTION

1. Field of the Invention

The present invention pertains to sailboats and, more particularly, to boom brakes for controlling the swinging motion of the booms of sailboats.

2. Discussion of the Prior Art

A jibe occurs when a sailboat changes course in a following or quartering wind. For example, if the wind is coming over the port, or left, rear quarter and the boat heads to starboard, the wind will then come over the starboard rear quarter requiring the sails to be reset. In the case of the mainsail, the mainsheet is pulled in until the mainsail fills on the other side, at which point the mainsail is let out to the correct position. An accidental jibe occurs when the boom swings freely across the deck because of a sudden change in wind direction, helmsman error or unexpected wave action. As the sail begins to fill on the new side in an accidental jibe, the mainsheet no longer restrains the boom, so the boom can very quickly gather a considerable amount of speed, and in one to three seconds from the start of the accidental jibe, the boom can pass over the cockpit. There is very little time to react, and the boom often weighs 40 to 60 lbs on an average boat. If someone is in the way, he or she will, at the least, receive an unpleasant knock, and can be killed by impact or knocked overboard as happens to sailors every year. One option to prevent such boom swings is to set a preventer, a line run from the boom forward, but such a line can be difficult to release offshore, especially at night and/or in rough conditions when the preventer line is needed most. Furthermore, when the preventer line is released an anxious moment is created as the crew tries to get the boom in.

Prior art sailboat boom motion control, as exemplified by U.S. Pat. No. 4,138,962 to Waelder, has utilized a brake line secured at opposite ends to the gunwales of the sailboat and passing through a device mounted on the boom for retarding the passage of the line by frictional resistance of one or more dead turns of the line around a fixed non-rotatable sheave. Retardation of the line is adjusted by removing or adding additional turns of the line around the fixed sheave; however, such adjustment is time consuming in all instances and difficult in rough weather. For coastal sailing, which generally requires frequent jibing and wind condition changes, such a procedure to appropriately adjust the brake resistance is unsatisfactory. In another approach, the brake line passes around a rotatable sheave with pivotable brake shoes disposed to bear against the inner surface of the sheave. The brake shoes are linked to the boom so that as the boom rises in response to increased wind pressure on the sail, the brake shoes are urged with increasing force against the sheave inner surface to retard the rotation of the sheave and increase the resistance of the device to passage of the brake line. Both of these approaches have the disadvantages of requiring expensive machined components and not being simply and adequately adjustable to change brake line resistance.

U.S. Pat. No. 4,941,420 to Heintz is exemplary of simpler boom brakes in which the frictional resistance to the passage of a line between the boat gunwales is developed by a turn or turns of the line around a non-rotatable smooth drum mounted on the boom. In practice, such boom brakes develop very rapid buildups of frictional resistance due to the flattening of the line against the flat drum sharply narrowing the range of boom motion control available. Multiple turns of the brake line around the drum create the problem of overwrapping of the line and jamming of the brake. Machining helical guide grooves in the drum surface to overcome the problem caused by overwrapping has the disadvantage of being expensive.

SUMMARY OF THE INVENTION

Accordingly, it is a primary object of the present invention to overcome the above disadvantages of the prior art by providing a boom brake for controlling the swinging movement of the boom of a sailboat that has a wide range of boom motion control while being inexpensive to manufacture.

Another object of the present invention is to control sailboat boom motion by selectively adjusting the frictional force developed on a line connected to the gunwales of the sailboat as the line passes over bearing surfaces in a boom brake attached to the boom.

The present invention has an additional object to provide a boom brake that avoids complete turns of a line around any single bearing surface to preclude the possibility of line jamming resulting from overwrapping.

A further object of the present invention is to provide a simple, accessible and quick method to selectively control the swinging movement of a sailboat boom.

The present invention has another object in the use of a plurality of fixed, non-rotating bearing surfaces in a boom brake to contact a brake line without requiring a complete turn around a bearing surface.

Some of the advantages of the present invention over the prior art are that the boom brake of the present invention allows the frictional resistance used to retard and control the swinging movement of a sailboat boom to be easily and quickly adjusted, the range of adjustment of frictional resistance can accommodate a variety of sailing conditions and requirements, the possibility of jamming as a result of line overwrap is eliminated, and the boom brake of the present invention can be economically manufactured and easily installed.

The present invention is generally characterized in a boom brake for controlling swinging movement of a sailboat boom by engaging a line secured to opposite sides of the sailboat including a housing for attachment to the boom of the sailboat, a plurality of bearing surfaces disposed within the housing for engaging the line, at least one of the bearing surfaces being rotatably mounted in the housing and means for selectively controlling resistance to rotation of the rotatable bearing surface. The present invention is further generally characterized in a boom brake for controlling swinging movement of a sailboat boom by engaging a line secured to opposite sides of the sailboat including a housing for attachment to the boom of the sailboat and a plurality of fixed, non-rotating bearing surfaces disposed within the housing for engaging the line, the plurality of bearing surfaces including first and second spaced upper bearing surfaces and a lower bearing surface disposed below the first and second upper bearing surfaces such that the line extends over the first upper bearing surface, under the lower bearing surface and over the second upper bearing surface.

Other objects and advantages of the present invention will become apparent from the following description of the preferred embodiment taken together with the accompanying drawings.

DESCRIPTION OF THE PREFERRED EMBODIMENT

Figure 1:
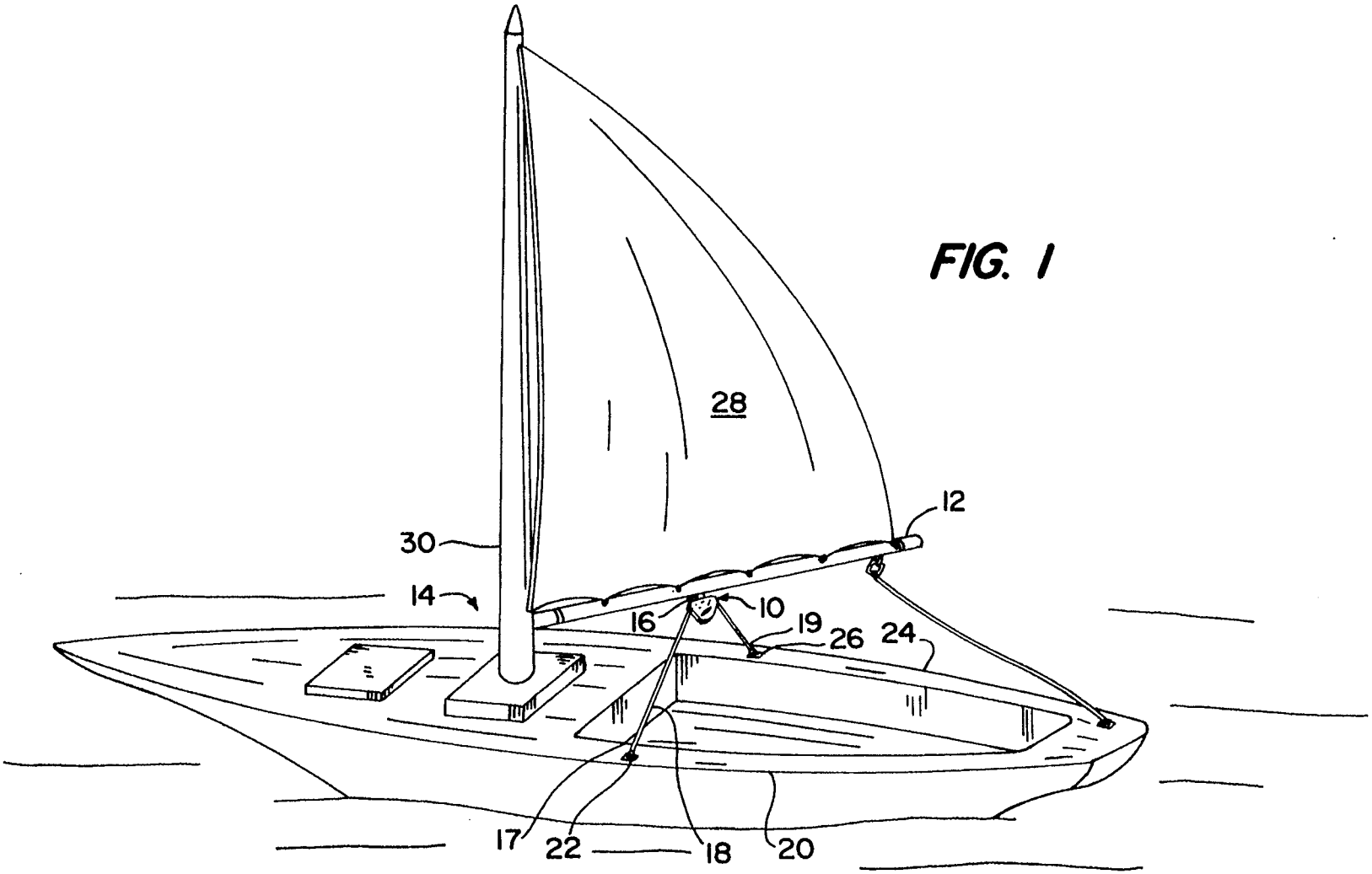
FIG. 1 is a perspective view showing a boom brake according to the present invention attached to the boom of a sailboat.

A boom brake 10 according to the present invention is shown in FIG. 1 attached to the boom 12 of a sailboat 14 by a mounting shackle 16. A brake line 18 having opposite ends 17 and 19 secured to the port gunwale 20 at cleat 22 and to the starboard gunwale 24 at cleat 26, respectively, passes through the boom brake 10 so that when a jibe occurs and the sail 28 and boom 12 swing around the mast 30, boom brake 10 translates along line 18.

Figure 2:
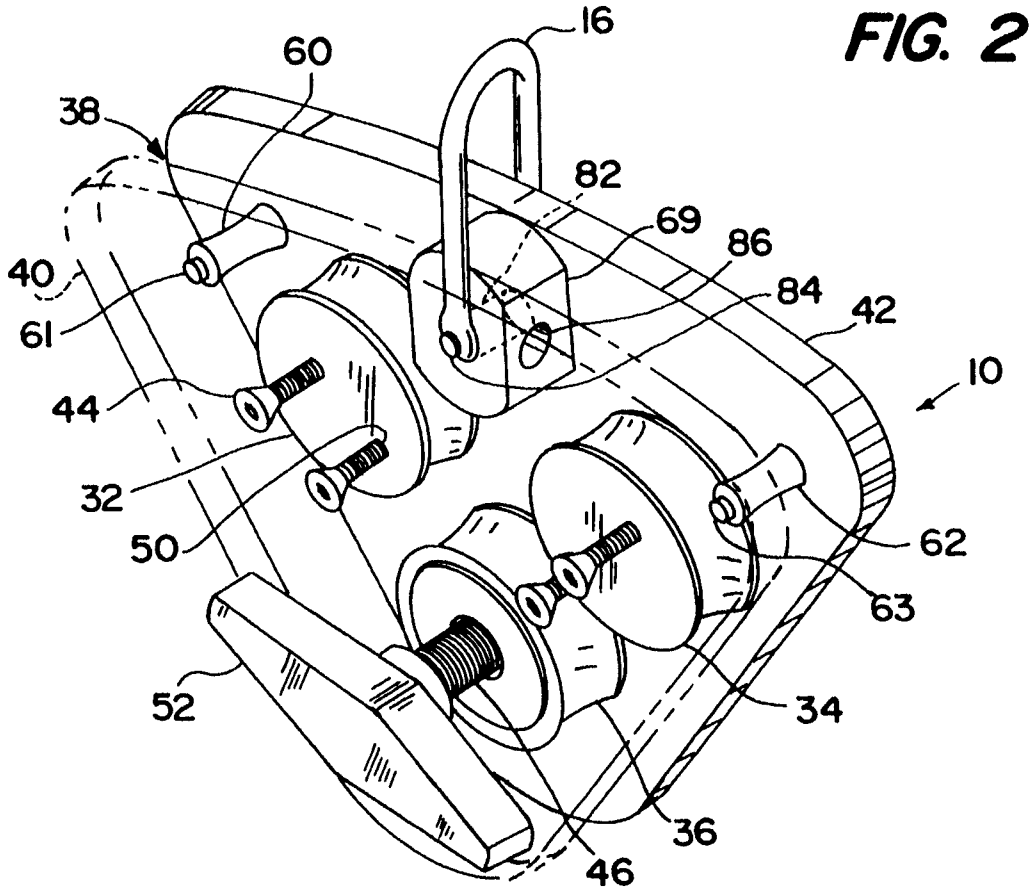
FIG. 2 is a perspective view of the boom brake of the present invention with the front housing plate in phantom.
Figure 3:
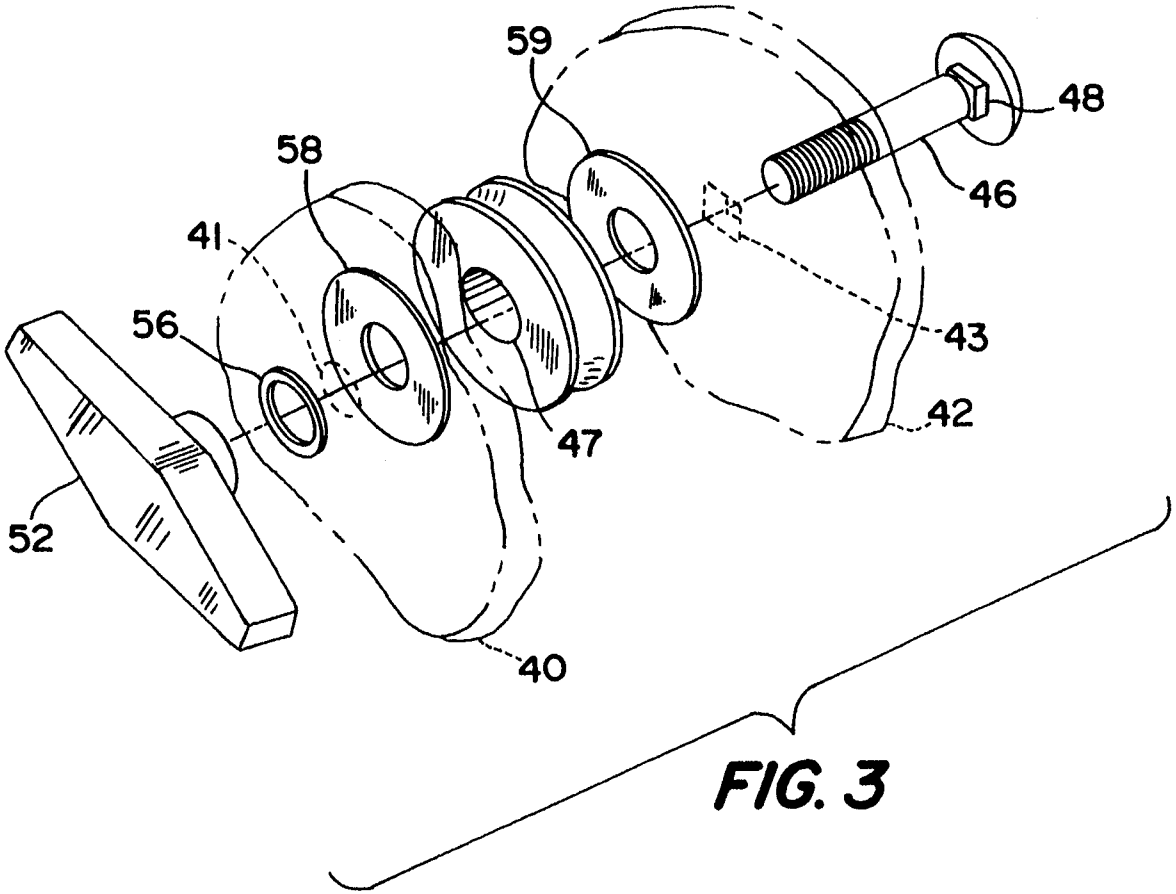
FIG. 3 is an exploded perspective view of the lower sheave assembly with the housing plates in phantom.

The boom brake 10, as shown in FIG. 2, has upper fixed bearing surfaces formed by sheaves 32 and 34 and a lower bearing surface formed by a sheave 36 mounted in a housing 38 between parallel plates 40 and 42 spaced such that the distance therebetween is, preferably, less than twice the diameter of line 18 and close to the line diameter such that the line is constrained to pass through the housing in a single plane. Upper sheaves 32 and 34 are non-rotatably fixed between plates 40 and 42 by hex bolts 44 countersunk into plate 40 and threadedly received in holes 50 in sheaves 32 and 34. If desired, additional hex bolts can be countersunk into plate 42 and threadedly received in holes on the opposite sides of sheaves 32 and 34. The lower sheave 36 is held in adjustable compression between plates 40 and 42 by a carriage bolt 46 extending through aligned holes 41 and 43 in plates 40 and 42, respectively, and a central bore hole 47 along the axis of rotation of lower sheave 36 as shown in FIG. 3. The diameter of bore hole 47 is larger than the diameter of bolt 46 so that sheave 36 can turn freely if desired. Hole 43 in plate 42 is cut square to non-rotatingly engage the square collar 48 of carriage bolt 46. A control knob 52 is threadedly engaged to the bolt opposite end and spaced from and held in position against plate 40 by a spring washer 56. Friction washers 58 and 59 are mounted between the rotatable sheave 36 and plates 40 and 42, respectively.

Figure 5:
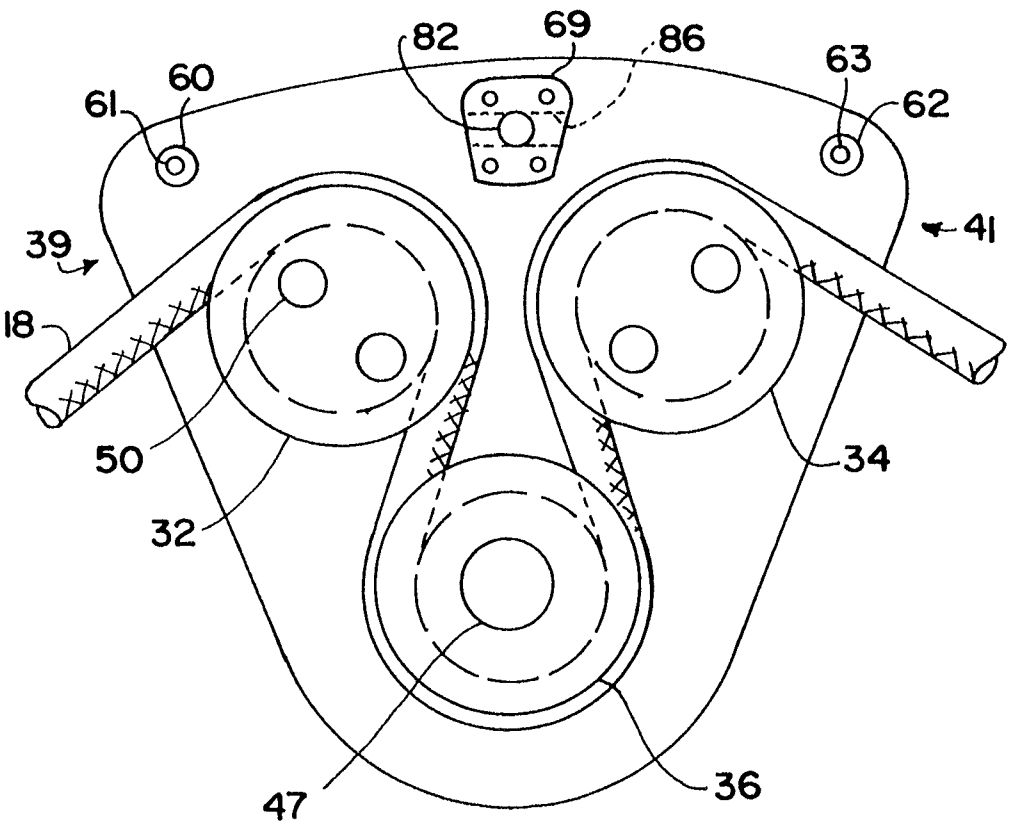
FIG. 5 is an elevation of the boom brake of the present invention with one housing plate removed showing the serpentine path of a line connected to the sides of a sailboat through the boom brake.

A guide 60 is mounted between plates 40 and 42 above and outboard of fixed sheave 32 on a split cylinder 61 force fit into bores in plates 40 and 42, and the space between guide 60 and fixed sheave 32 defines a first portal 39, as shown in FIG. 5, through which brake line 18 passes from the port side of the boat into the boom brake. A guide 62 is mounted above and outboard of fixed sheave 34 on a split cylinder 63 force fit into bores in plates 40 and 42, and the space between guide 62 and fixed sheave 34 defines a portal 45 shown in FIG. 5 through which the brake line passes toward the starboard side of the boat. Guides 60 and 62 channel line 18 into and out of the housing 38 and prevent line 18 from sliding over the top of the housing and interfering with the opposite side of the line.

Figure 4:
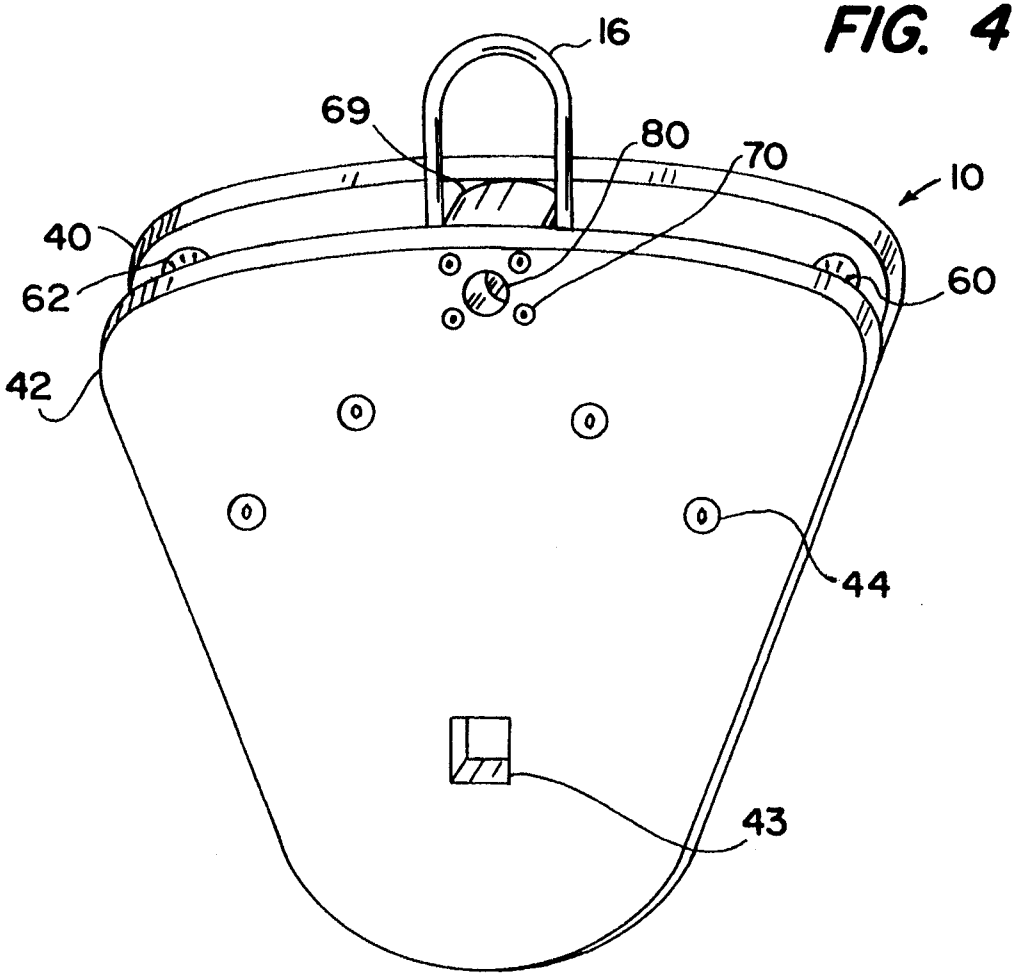
FIG. 4 is a perspective rear view of the boom brake of the present invention with the lower sheave bolt removed.

A spacer plug 69 is rigidly mounted between plates 40 and 42 at the top of housing 38 by hex bolts 70 countersunk into plate 42 as shown in FIG. 4 and threadedly received in holes in spacer plug 69. If desired, additional hex bolts can be countersunk into plate 40 and threadedly received in holes on the opposite side of plug 69 as well. Plates 40 and 42 have aligned holes 78 and 80, respectively, and spacer plug 69 has a hole or bore 82 sized to loosely receive shackle pin 84 in perpendicular orientation to plates 40 and 42. Spacer plug 69 also has a bore 86 (in phantom) to allow shackle 16 to be alternatively mounted with shackle pin 84 parallel to plates 40 and 42.

Figure 6:
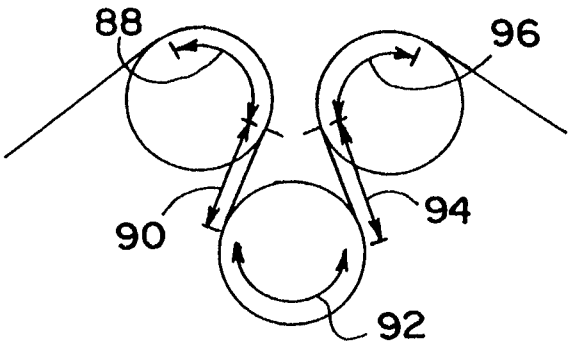
FIG. 6 is a schematic of the curved and straight leg portions of the serpentine path of a line through the boom brake.

As shown in FIGS. 5 and 6, the brake line passes through the boom brake in a serpentine path. More particularly, the brake line 18 enters the housing 38 through portal 39 between guide 60 and sheave 32, makes a partial turn in frictional engagement with sheave 32 along a curved path portion 88, continues along a straight leg path portion 90 to rotatable sheave 36, makes a partial turn in frictional engagement along a curved path portion 92, continues along a straight leg path portion 94 to fixed sheave 34, makes a partial turn in frictional engagement along a curved path portion 96 and exits the housing through portal 45 between guide 62 and sheave 34. As the boom 12 swings across the sailboat during a jibe, sliding contact between the line 18 and the line-engaging bearing surfaces 32, 36 and 34 defining curved path portions 88, 92 and 96 creates a frictional resistance force opposing and braking the swinging motion of the boom. Minimum resistance to line passage occurs when the rotatable sheave 36 is allowed to turn freely and is determined by the frictional contacting area between the line and the curved bearing surfaces on fixed sheaves 32 and 34. The minimum resistance can be adjusted by altering the size or number of fixed sheave contacts. Maximum resistance is obtained by completely dogging down, or tightening, control knob 52 in threaded engagement with bolt 46 to draw plates 40 and 42 together, compressing friction washers 58 and 59 into non-rotatable sliding frictional contact with the sides of rotatably mounted sheave 36 such that all of the bearing surfaces are fixed and non-rotatable. If adjustable braking is not required in the boom brake, the boom brake can be inexpensively made with only fixed, non-rotatable bearing surfaces, preferably formed of sheaves or other smoothly curved components, such that all three line-engaging bearing surfaces are in sliding frictional contact with the line 18. The boom brake can be adjusted to any intermediate resistance between the minimum and maximum values by selectively tightening the control knob 52 to vary the compressive force exerted by plates 40 and 42 on friction washers 58 and 59 which bear in sliding frictional contact with rotatable sheave 36 to vary the rotational resistance of sheave 36 and, consequently, the frictional force developed along curved path portion 92 and the line 18. Spring washer 56 prevents control knob 52 from rotating away from the selected position.

In a specific embodiment using upper fixed sheaves having diameters of about 3 inches and mounted with centers of curvature spaced about 3½ inches apart and a lower sheave having a diameter of about 3 inches and a center of curvature mounted about 3 inches below and centered between the centers of curvature of the upper sheaves, the serpentine path of line 18 will describe a bearing surface arc of about 170° along curved path portions 88 and 96 and will describe a bearing surface arc of about 220° along curved path portion 92. Alternate diameters and spatial patterns can be designed to produce a wide range of frictional contacting area between the line and the bearing surfaces.

The boom brake of the present invention can be rigged or installed in place on a sailboat by simply securing mounting shackle 16 to the sailboat boom 12, securing an end of the brake line 18 to portside cleat 22, passing the line through the boom brake in a serpentine path as shown in FIG. 5, tightening the line and then securing the other end of line 18 to starboard cleat 26. Control knob 52 can then be rotated to compress plates 40 and 42 toward one another until sufficient frictional resistance is developed between the rotatable sheave 36 and friction washers 58 and 59 to produce the degree of resistance to the passage of brake line 18 required by the sailing conditions. Adjustment in response to changing conditions requires rotation of control knob 52 to increase or decrease the boom brake resistance.

The resistance exerted by boom brake 10 to the passage in either direction of line 18 and, consequently, the degree to which rapid swinging motion of the boom is suppressed can be quickly and easily adjusted in response to varying sailing conditions by simply rotating control knob 52 to increase or decrease the compression applied by plates 40 and 42 on rotatable sheave 36. Rotational resistance can be adjustably applied to rotatable sheave 36 or an axle of sheave 36 using a variety of conventional braking or friction applying arrangements. The serpentine path taken by line 18 through the boom brake avoids any overlapping and, thus, avoids the possibility of jamming as a result of overwrapping.

Sheaves provide side support to the line to maintain a fairly constant contacting area between the line and the bearing surface; however, components of other shapes having smoothly curved frictional engagement bearing surfaces to contact the line can be used with or without grooves. The number and lengths of smoothly curved bearing surfaces, both fixed and adjustably rotatable, can be designed to achieve a wide range of operating resistances.

Inasmuch as the present invention is subject to many variations, modifications and changes in detail, it is intended that all subject matter discussed above or shown in the accompanying drawings be interpreted as illustrative and should not to be taken in a limiting sense.

What is claimed is:

1. A boom brake for controlling the swinging movement of a sailboat boom by engaging a line secured to opposite sides of the sailboat comprising:

a housing for attachment to the boom of the sailboat;

a plurality of bearing surfaces disposed within said housing for engaging the line;

at least one of said bearing surfaces being rotatably mounted in said housing, said plurality of bearing surfaces includes first and second spaced upper bearing surfaces and a lower bearing surface disposed below said first and second upper bearing surfaces such that the line extends over said first upper bearing surface, under said lower bearing surface and over said second upper bearing surface in a serpentine path making only a partial turn on each of said bearing surfaces; and means for selectively controlling resistance to rotation of said rotatable bearing surface.

2. A boom brake for controlling the swinging movement of a sailboat boom as recited in claim 1 wherein said first and second upper bearing surfaces are non-rotatably fixed in said housing and said lower bearing surface is rotatably mounted in said housing.

3. A boom brake for controlling the swinging movement of a sailboat boom as recited in claim 1 wherein said housing includes first and second spaced parallel plates and said means for selectively controlling resistance to rotation includes means for compressing said first and second plates to contact said at least one rotatably mounted bearing surface with a variable force.

4. A boom brake for controlling the swinging movement of a sailboat boom as recited in claim 2 wherein said lower bearing surface includes a sheave having an axis of rotation and a bore along said axis of rotation and said compressing means includes a bolt extending through said first and second plates and said bore through said sheave.

5. A boom brake for controlling the swinging movement of a sailboat boom as recited in claim 4 wherein said compressing means includes a knob threadedly engaging said bolt.

6. A boom brake for controlling the swinging movement of a sailboat boom as recited in claim 1 and further comprising a first guide disposed in said housing spaced from said first upper bearing surface to define a first portal for receiving the line and a second guide disposed in said housing spaced from said second upper bearing surface to define a second portal for receiving the line.

7. A boom brake for controlling the swinging movement of a sailboat boom as recited in claim 2 wherein said first and second upper bearing surfaces are formed by sheaves.

8. A boom brake for controlling the swinging movement of a sailboat boom as recited in claim 1 wherein said housing includes first and second spaced parallel plates and said means for selectively controlling resistance to rotation includes means for compressing said first and second plates to contact said at least one rotatably mounted bearing surface with a variable force.

9. A boom brake for controlling the swinging movement of a sailboat boom as recited in claim 8 wherein said at least one rotatably mounted bearing surface includes a sheave having an axis of rotation and a bore along said axis of rotation and said compressing means includes a bolt extending through said first and second plates and said bore through said sheave.

10. A system for controlling the swinging movement of a sailboat boom comprising:

a boom brake for attachment to the sailboat boom having first and second fixed non-rotatable bearing surfaces and a rotatable bearing surface, said first and second fixed bearing surfaces being spaced from said rotatable bearing surface;

a line having opposite ends for attachment to opposite sides of the sailboat, said line passing through said boom brake in a single plane along a serpentine path in engagement with said first and second fixed bearing surfaces and said rotatable bearing surface, said line making only a partial turn on each of said first and second fixed bearing surfaces and said rotatable bearing surface, said line passing from said first bearing surface to said rotatable bearing surface along a first straight leg of said serpentine path, around said rotatable bearing surface along a curved portion of said serpentine path, and from said rotatable bearing surface along a second straight leg of said serpentine path to said second fixed bearing surface; and said boom brake including means engaging said rotatable bearing surface with a variable force for selectively controlling resistance to rotation of said rotatable bearing surface.

11. A boom brake for controlling swinging movement of a sailboat boom by engaging a line secured to opposite sides of the sailboat comprising a housing for attachment to the boom of the sailboat; and a plurality of fixed, non-rotating bearing surfaces disposed within said housing for engaging the line, said plurality of bearing surfaces including first, second and third spaced bearing surfaces disposed such that the line passes through said housing in a single plane along a serpentine path making only a partial turn on each of said bearing surfaces.

* * * * *